US005193803A

United States Patent [19]

Flick III

[11] Patent Number: 5,193,803

[45] Date of Patent: Mar. 16, 1993

[54] GOLF TEE

[76] Inventor: Conrad Flick III, 3715 ½State St., Bettendorf, Iowa 52722

[21] Appl. No.: 803,782

[22] Filed: Dec. 6, 1991

Related U.S. Application Data

[63] Continuation of Ser. No. 482,701, Feb. 21, 1990, abandoned.

[51] Int. Cl.[5] ..... A63B 57/00

[52] U.S. Cl. ..... 273/33

[58] Field of Search ..... 273/33, 201-212

[56] References Cited

U.S. PATENT DOCUMENTS

| | | | |
|---|---|---|---|
| 1,583,897 | 5/1926 | Oldring | 273/206 |
| 1,638,527 | 8/1927 | Clausing | 273/211 |
| 1,664,400 | 4/1928 | Copp | 273/205 |
| 1,715,026 | 5/1929 | Barnes | 273/205 |
| 1,717,962 | 6/1929 | Deike | 273/207 |
| 1,781,684 | 11/1930 | Dunkelsberg | 273/205 |
| 1,976,316 | 10/1934 | Whitelaw | 273/205 |
| 2,051,734 | 8/1936 | Maden, Jr. | 273/205 |
| 2,082,811 | 6/1937 | Thorup | 273/33 |
| 2,094,320 | 9/1937 | Fijik | 273/206 |
| 2,160,122 | 5/1929 | Bumsly | 273/211 |
| 2,508,155 | 5/1950 | Gerlach | 273/205 |
| 3,782,723 | 6/1974 | Morris | 273/33 |
| 3,907,289 | 9/1975 | Bondu | 273/33 |
| 3,947,027 | 3/1976 | Brown | 273/33 |
| 4,192,504 | 3/1980 | Cougage | 273/33 |
| 4,205,841 | 6/1980 | Silva | 273/33 |

*Primary Examiner*—Theatrice Brown

*Attorney, Agent, or Firm*—Bradford E. Kile; Ruffin B. Cordell

[57] ABSTRACT

A golf tee for supporting a golf ball to be struck by a golf club which will ensure contact of the golf ball by the club prior to contact between the club and tee including a golf tee body, a stanchion or stem to supportingly engage a ground surface and a cantilevered support for a golf ball laterally offset from the stem toward the intended approaching path of a golf club swing to strike the ball.

5 Claims, 2 Drawing Sheets

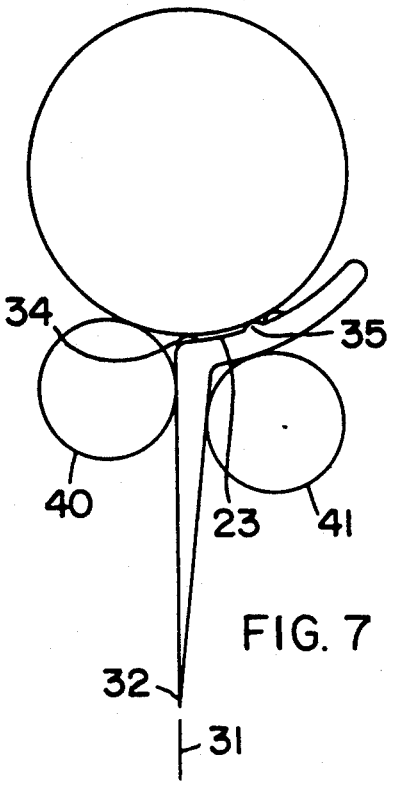
FIG. 7
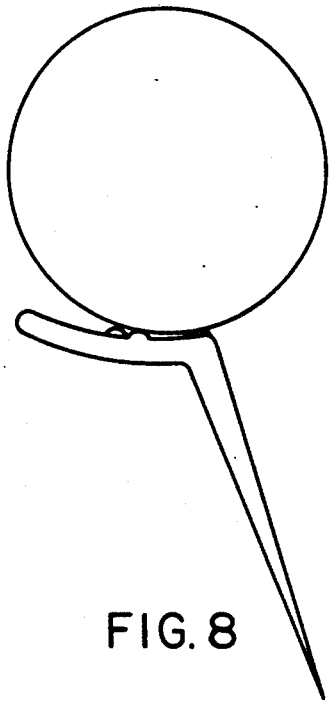
FIG. 8
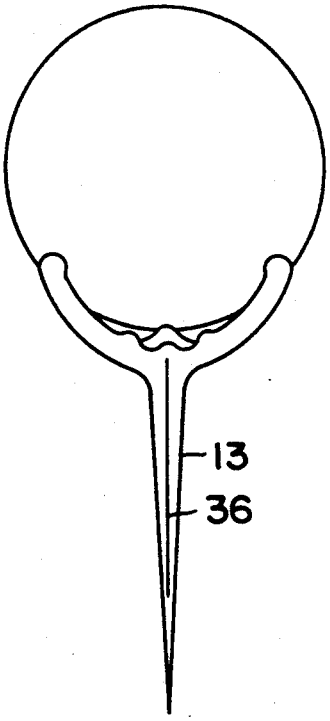
FIG. 9
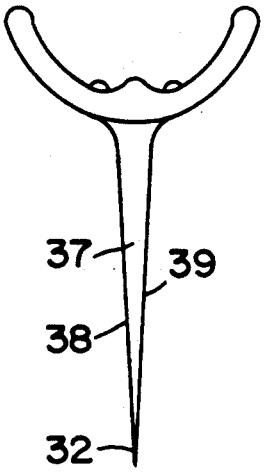
FIG. 10
FIG. 11
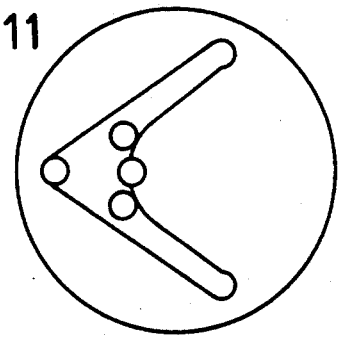
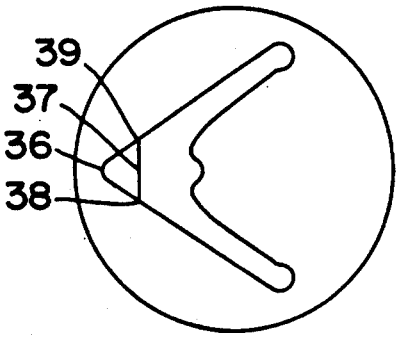
FIG. 12

GOLF TEE

This application is a continuation, of application Ser. No. 482,701, filed Feb. 21, 1990 (abandoned).

BACKGROUND OF THE INVENTION

This invention relates to a novel support for a golf ball. More specifically this invention relates to a golf ball tee which has no interaction with the golf club face prior to the face striking the elevated ball regardless of the club selected.

Golf is a sport enjoyed by the public throughout the world. It requires no special physical attributes or knowledge for enjoyable participation. It is a sport that can be played without the aid of a team or against a competitor. The ultimate competition, whether playing solely or in a group, is between the player and the course.

Enjoyment is the reason for playing for the majority of the players. With this enjoyment there is a certain desire to excel past your current level of ability. The greatest realized improvement comes from the mastering of one's golf swing. Next attention is often directed to equipment. This phenomena in some respects may be psychological as well as a physical advantage, the right brand of clubs, the best balls, even the proper attire. Players constantly strive for the little competitive edge.

The use of golf tees to elevate a ball above a ground surface to facilitate clean striking of the ball off the tee by a professional and/or amateur golfer has been known for years. The placement of the ball on a simple mound of turf may have been the first form of a tee. Obviously informal tees make it difficult to position a ball consistently.

Another early form of golf tee assumes the form of an upward opening cup receptacle directly above a tapered ground penetrating stem. This tee supports the ball fine for strokes using clubs having near vertical faces. However, using this tee with clubs having a 35 degree slope (6 iron) or greater, a golfer may strike the tee stem before the ball on swings without a perfect arc height.

Another previously known tee is to form a cup receptacle at an acute angle with the stem in the direction of the swing. It is claimed that this minimizes breakage and offers less resistance to a golf swing. However this prior design enhances club face tee interaction prior to striking the ball with the club causing a unpredictable positioning and movement of the ball. Moreover the angled stem, on some versions, is in the view of a golfer; possibly interfering with concentration.

Another variation contains pointed protrusions on the circumference of the cup receptacle for directional alignment and to prevent loss. With the stem location the same as above, one encounters identical situations with striking the stem prior to the ball.

In at least one further known golf tee, an upper ball supporting surface is laterally enlarged to ensure contact of a club force with the tee prior to contacting the ball. It is asserted that this provides a degree of backspin to the ball prior to contact with a golf club. This tee may also, however, impart inconsistent movement of the ball prior to contact with a club face.

Although previously known golf tees generally have received considerable use, it would be highly desirable to provide a golf tee easily used, with structural integrity, inexpensive to manufacture, and offers no interference in the golf swing.

The difficulties and limitations suggested in the preceding are not intended to be exhaustive but rather are among many which may tend to reduce the effectiveness and user satisfaction with prior golf tees. Other noteworthy problems may also exist; however, those presented above should be sufficient to demonstrate that golf tees appearing in the past will admit to worthwhile improvement.

OBJECTS AND BRIEF SUMMARY OF THE INVENTION

Objects

It is therefore a general object of the invention to provide a novel golf tee which will obviate or minimize problems of the type previously described.

It is a specific object of the invention to provide a novel golf tee which will prevent interference or contact of the golf tee with the golf club face prior to striking the ball.

It is another objective of this invention to provide a novel tee which provides a total uninterrupted exposure to the club face of the ball.

It is yet another object of this invention to provide a novel tee which is concealed from a golfer's view when a golfer addresses the golf ball so as to not interfere with concentration.

It is still another object of the invention to provide a novel tee which presents the smallest profile of the stem to offer resistance against the earth when struck with the club.

It is a specific object of the invention to provide a novel tee which is easily disposed into a ground surface.

BRIEF SUMMARY OF A PREFERRED EMBODIMENT OF THE INVENTION

A preferred embodiment of the invention which is intended to accomplish at least some of the foregoing objects entails a golf tee comprising a ball receptacle uniquely catilevered from a ground engaging stanchion. This ball receptacle consists of three raised domed projections. A front projection is positioned on the tee body approximately in its center and slightly ahead of an imaginary vertical line extending through the center of a ball, and to the rear of the stem. Two rear projections lie in a horizontal plane elevated slightly above the front surface and slightly to the rear of an imaginary vertical ball. These rear projections are low enough to be concealed beneath the ball. The rear domed surfaces are supported on two outwardly acuate arms extending rearwardly from the tee body. These arms are removed from the rear surface of the ball to prevent interference with a golf club even if the tee placement is not in perfect alignment with the club swing.

The golf tee stem or stanchion consists of a triangulated spike with the leading edge vertical and continuous and the trailing side sloping forward from the top to the tip. This creates an overall tapering of the sides to the eventual tip without compromising the front edge.

Directly above the tip of the ground engaging spike is a frontal platform with a center line common to the vertical axis through the tip. This platform imitates a golf ball curvature and has three domed projections in a triangular relationship. This is to facilitate positioning of the tee into a ground surface by placing a ball on these projections and pressing firmly downward.

DRAWINGS

Other objects and advantages of the present invention will become apparent from the following detailed description of a preferred embodiment thereof taken in conjunction with the accompanying drawings' wherein:

FIG. 7 is a side elevational view of in accordance with the preferred embodiment of the invention and depicts a golfer's finger placement.

FIG. 8 is a side elevation similar to FIG. 7 which has been rotated 180 degrees with a golf ball positioned for driving;

FIG. 9 is a side elevation of a tee in accordance with the preferred embodiment of the invention with a golf ball positioned for tee placement;

FIG. 10 is front view of the invention;

FIG. 11 is a top view of the golf tee;

FIG. 12 is a bottom view of the golf tee;

DETAILED DESCRIPTION

Figure 1:
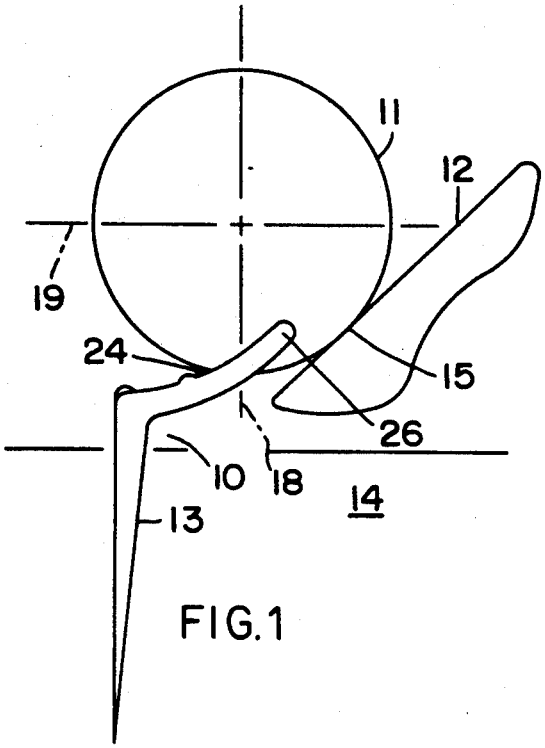
FIG. 1 is a side elevation depicting a golf ball positioned on a novel tee in accordance with a preferred embodiment of the invention, at the moment of contact with a 9 iron having a blade slope of 47 degrees with respect to the vertical.

Referring now to the drawings, wherein like numerals indicate like parts, and initially to FIG. 1, there will be seen the striking-position relationship of a golf tee 10, a golf ball 11, and a golf club face 12 in a side elevation view in accordance with a preferred embodiment of the invention. A stem or stanchion 13 of the golf tee 10 is disposed a desired depth into the ground surface or turf 14. The club face 12 has completed its downward, arced swing and is about to strike ball surface 15. The great circle 15 of the golf ball 11 is presented to the club face without obstruction. The predetermined position of golf ball 11 will remain exact throughout the entire swing until actual contact.

Figure 2:
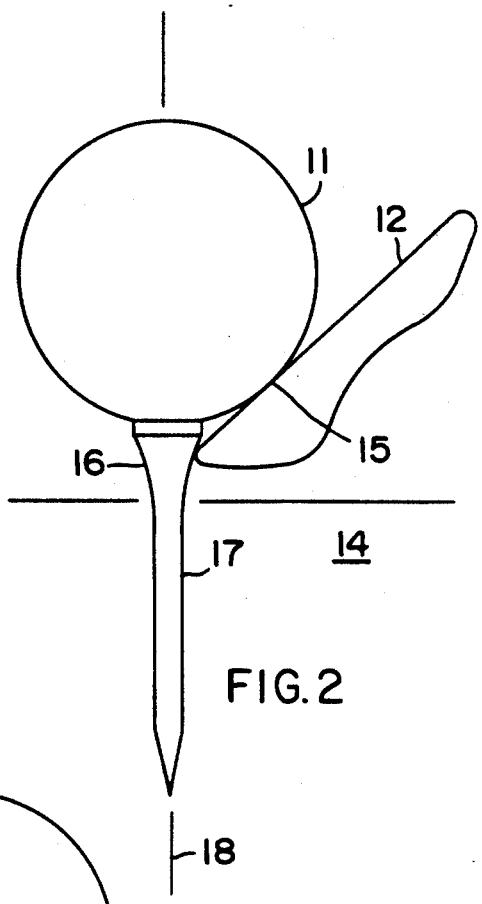
FIG. 2 is a side elevation depicting a golf ball positioned on a conventional tee at the moment of contact with a 9 iron having a blade slope of 47 degrees.

Referring now to FIG. 2, the striking relationship of golf ball 11, a club face 12, with a low swing arc identical to FIG. 1, and a conventional golf tee 16 is shown in side elevation. The stem 17 is disposed into the turf 14 directly below the golf ball 11 and shares a common center line 18 with the ball. Club face 12 may contact tee stem 17 prior to the golf ball surface 15. This will cause a momentary random positioning of golf ball 11 prior to the actual club face contact.

Figure 3:
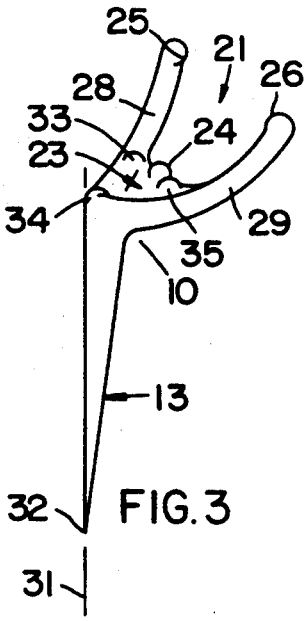
FIG. 3 is a front axonometric view of a golf tee in accordance with the preferred embodiment of the invention.

FIG. 3 reveals a front axonometric view of a golf tee in accordance with a preferred embodiment of the invention. The golf tee 10 is comprised of three cooperating structures; a ball receptacle or supporting zone 21, a ground engaging stanchion or stem 13, and a tee body 23.

The ball support receptacle 21 is preferably comprised of three domed projections; 24, 25, and 26, as shown in FIGS. 1 and 3. Projection 24 is generally central to the tee body platform and slightly forward of an imaginary vertical line 18 extending through the center of a golf ball 11. This projection 24 extends from the tee placement platform 23 and operably serves to retain a golf ball 11 in a position preventing unwanted forward movement. Opposing support surfaces 25 and 26 lie in the same horizontal plane which is slightly above and laterally spaced from projection 24. The pair of surfaces 25 and 26 are slightly behind a central vertical axis 18 of a golf ball but are preferably low enough to be concealed beneath the central, horizontal ball equator 19. Projections 25 and 26 extend from terminating ends of supporting arms 28 and 29. The supporting arms 28 and 29 originate from the sides of the golf tee body 23 and trace an outwardly and upwardly acuate path and terminate at points behind an imaginary vertical line 18 extending through the center of a ball and below a central, horizontal axis 19 of a ball.

The tee body includes placement platform having a concave surface with a radius similar to that of a golf ball. Three domed projections, 33, 34, and 35 are in a triangular position with projection 34 leading 33 and 55. In order to facile engage the subject golf tee within a ground surface, a golf ball 11 is placed on projections 33, 34 and 35 and the tee is operably pressed into the turf 14. A golfer's finger placement is illustrated generally by circles 40 and 41.

FIG. 8 discloses an ability to reverse the tee and use projections 33, 34 and 35 to alternatively support a ball as a driving tee.

The ground engaging stem or stanchion 13 is preferably a triangulated spike with tip 32 and is normally extended from the tee body. A leading edge 36 of the stem 13 is essentially vertical and continuous. A sloping rear side 37 creates a tapering configuration of the stanchion 13. The two rear stem edges 38 and 39 slope inwardly merging at the stem tip 32 as shown in FIGS. 9, 10, 11 and 12.

Figure 4:
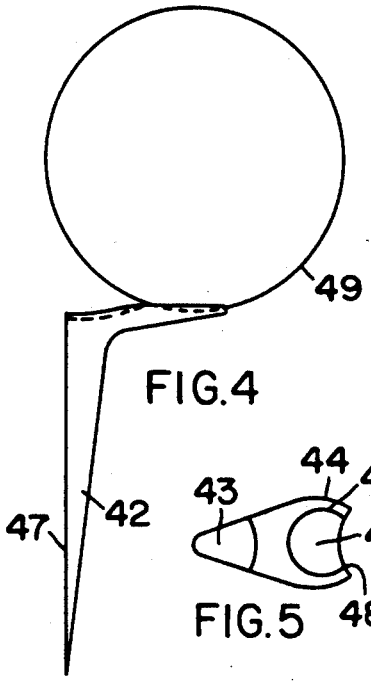
FIG. 4 is a side elevation of an alternate preferred embodiment of the invention.
Figure 5:
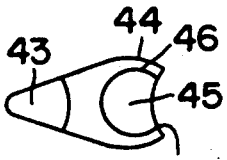
FIG. 5 is a top view of this alternate embodiment.
Figure 6:
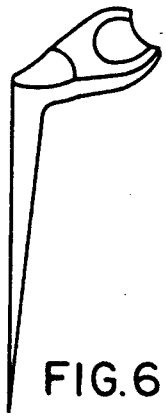
FIG. 6 is a front axonometric view of this alternate embodiment depicted in FIG. 4.

FIGS. 4, 5 and 6 disclose an alternate preferred, embodiment of the invention. The structural difference in this embodiment is primarily the ball support member. The ball support member includes a receptacle 44 having an upward opening with a dished surface 45 and a discontinuous periphery 46, normal to the leading edge 47 of the stem 42. The intersection of arc 48 with receptacle 44 allows for the uninterrupted exposure of ball surface 49 to a club face. This receptacle surface 44 may also consist of discontinuous periphery arms 46 and omitting the upward opening portion 45.

In front of the ball support receptacle surface is an acuate depression 43 which lies above the stem or stanchion 42 and operably receives temporary placement of a ball to assist in inserting the stanchion or stem 42 into a ground surface.

SUMMARY OF MAJOR ADVANTAGES OF THE INVENTION

After reading and understanding the foregoing description of presently preferred embodiments of the invention, in conjunction with the accompanying subject drawings, it will be appreciated that several distinct advantages of the subject golf tee are obtained.

Without attempting to set forth all of the desirable features of the instant golf tee, at least some of the major advantages of the invention include a golf tee that suspends a golf ball for complete exposure to a club face by cantilevering it to the rear of the tee stanchion or stem. The club face now contacts the ball surface first before any portion of the tee is struck. This provides a clean hit without imparting errant or inconsistent motion to the ball as might occur if a golf club were permitted or induced to strike a golf tee before striking the ball.

A triangulated array of domes or surfaces provide stable ball support without interfering with the flight of the ball from the tee. Moreover the support surfaces are beneath the ball and essentially hidden from a golfer's line of sight when addressing the ball.

With the ball receptacle removed from a direct vertical placement over the stem tip, the tee is easily disposed into the ground by placing the ball on front platform projections and pressing downward.

The triangulated stem reveals the smallest profile to the ground, thus the least resistance when driven forward by the strike of the club face. The simple twisting of the triangulated stem also assists its entry into solid ground.

In order to prolong the integrity of the cantilevering members, the tee may be rotated 180 degrees when using clubs having a face slope of 35 degrees or less. The ball placement receptacle becomes the driving platform and the stem axis forms an acute angle with the club swing axis. The tee structure still remains essentially concealed beneath the ball.

Still further the subject golf tee is efficient in design, compact and extremely rugged.

In describing the invention, reference has been made to preferred embodiments and illustrative advantages of the invention. Those skilled in the art, however, and familiar with the instant disclosure of the subject invention, may recognize additions, deletions, modifications, substitutions and/or other changes which will fall within the purview of the subject invention and claims.

What is claimed is:

1. A golf tee for supporting a golf ball to be struck by a golf club which will ensure contact of the golf ball by the golf club prior to contact between the golf club and the golf tee, said golf tee comprising:

a golf tee body;

a triangulated stanchion having a continuous leading edge connected at one end to the golf tee body and converging to a tip at the other end to penetrate into a ground surface for support of the stanchion in an upright posture with respect to the ground surface;

a golf ball support connected to said golf tee body comprising at least three ball engaging members including a leading ball engaging member and a pair of spaced trailing ball engaging members, said pair of spaced trailing ball engaging members include a pair of mirror image arms extending rearwardly away from said golf tee body in an arcuate, upward and outward posture, said leading ball engaging member comprises a knob mounted upon said golf tee body, and said pair of mirror image arms terminate in mutually opposing ball sopping knobs which cooperate with the knob of said leading ball engaging member to form a triangular three point bearing support for a golf ball; and three additional ball engaging members extending upwardly from the golf tee body for temporarily receiving a golf ball and for permitting a vertical force to be applied by a person to a golf ball placed one said tee to facilitate penetration of said stanchion into a ground surface, wherein an imaginary line extending generally vertical to a ground surface and through the center of a golf ball resting upon golf balls support being laterally offset from an imaginary line extending through a central longitudinal axis of said stanchion such that a golf club face will strike the golf ball prior to making contact with the golf tee to thereby ensure unobstructed contact of the golf ball by the golf club without contact between the golf club and the golf tee prior to contact of the golf club with the golf ball.

2. A golf tee for supporting a golf ball to be struck by a golf club which will ensure contact of the golf ball by the golf club prior to contact between the golf club and the golf tee, said golf tee comprising:

a golf tee body;

a stanchion connected at one end to the golf tee body and operably at the other end to penetrate into a ground surface for support of the stanchion in a generally vertical upright posture with respect to the ground surface;

means extending form said golf tee body for receiving a golf ball and for permitting a vertical force to be applied by a person to a golf ball and to said golf tee body facilitating penetration of said stanchion into a ground surface; and means connected to said golf tee body for supporting a golf ball above a ground surface, said means for supporting being cantilevered from the tee body and extending substantially in the direction of intended approach of a golf club and being of a pair of mutually opposing arcuate arms for operably supporting a golf ball, the golf tee operably being within an imaginary vertical cylinder having a diameter defined by the periphery of a golf ball when positioned upon the golf tee wherein an imaginary line extending generally vertical to the to round surface and through the center of a gold ball resting upon said means for supporting being laterally offset from an imaginary line extending through a central longitudinal axis of said stanchion and said offset of an imaginary line extending generally vertical to the ground surface being in the direction of an approaching golf club face operable to contact the golf ball such that when a golf ball is positioned upon said means for supporting and offset toward an intended approaching path of a golf club face from said stanchion, the golf club face will strike the golf ball prior to making contact with the golf tee to thereby ensure unobstructed contact of the golf ball by the golf club without contact between the golf club and the golf tee prior to contact of the golf club with the golf ball.

3. A golf tee as defined in claim 2 wherein said means for supporting comprises:

first means extending from said body portio of the golf tee and being positioned in front of an imaginary vertical line intersecting the center of a ball when positioned upon said tee and to the rear of an imaginary vertical line extending coincident with a longitudinal central axis of said stanchion; and two rearwardly directed, outwardly projecting member originating from the tee body and terminating to the rear of the imaginary vertical center line of a ball when positioned upon said tee.

4. A golf tee as defined in claim 2 wherein said stanchion comprises:

a triangulated solid stem in cross-section with a vertical, continuous front edge and a slanting rear side with converging edges that eventually merge with the front edge to create a pointed tip.

5. A golf tee for supporting a golf ball to be struck by a golf club which will ensure contact of the golf ball by the golf club prior to contact between the golf club and the golf tee, said golf tee comprising:

a golf tee body;

a stanchion connected at one end to the golf tee body and having a tip at the other end operable to penetrate into a ground surface for support of the stanchion in an upright posture with respect to the ground surface;

a golf ball support connected to said golf tee body comprising at least three ball engaging members including a first ball engaging member and a pair of spaced ball engaging members, said pair of spaced ball engaging members include a pair of mirror image arms extending rearwardly away from said golf tee body in an arcuate, upward and outward posture, said pair of mirror image arms terminate in mutually opposing ball supporting means which cooperate with said first ball engaging member to form a bearing support for a golf ball; and additional ball engaging means of said golf tee body for temporarily receiving a golf ball and for permitting a vertical force to be applied by a person to a golf ball to facilitate penetration of said stanchion into a ground surface, wherein an imaginary line extending generally vertical to a ground surface and through the center of a golf ball resting upon golf ball support being laterally offset from an imaginary line extending through a central longitudinal axis of said stanchion such that a golf club face will strike the golf ball prior to making contact with the golf tee to thereby ensure unobstructed contact of the golf ball by the golf club without contact between the golf club and the golf tee prior to contact of the golf club with the golf ball.

* * * * *